United States Patent [19]

Rudeen et al.

[11] 3,994,231

[45] Nov. 30, 1976

[54] GUIDED MISSILE WARHEAD FUZE

[75] Inventors: James C. Rudeen; Wilbur B. Lunt, both of China Lake; John S. Markall, Corona, all of Calif.

[73] Assignee: The United States of America as represented by the Secretary of the Navy, Washington, D.C.

[22] Filed: Dec. 8, 1971

[21] Appl. No.: 206,216

[52] U.S. Cl. ..... 102/81; 102/49.6

[51] Int. Cl.[2] ..... F42C 5/00; F42C 15/06

[58] Field of Search ..... 102/76, 77, 78, 79, 102/80, 81, 81.2, 49.6

[56] References Cited

UNITED STATES PATENTS

| | | | |
|---|---|---|---|
| 1,975,809 | 10/1934 | Teitsheid | 102/78 |
| 2,704,033 | 3/1955 | Koeper et al. | 102/49.6 |
| 2,872,869 | 2/1959 | Rasmussen | 102/81 |
| 2,918,870 | 12/1959 | Meister | 102/49.6 |
| 2,969,737 | 1/1961 | Bild | 102/81 X |
| 3,115,832 | 12/1963 | Gres | 102/81 X |

*Primary Examiner*—David H. Brown

*Attorney, Agent, or Firm*—R. S. Sciascia; Roy Miller

[57] ABSTRACT

A guided missile fuze comprising a safety-arming mechanism. Upon intentional launch of the missile the explosive train of the fuze is mechanically and electrically aligned, provided prescribed launch and flight events occur and a specific time has elapsed. The first step in the arming cycle of the present invention is the transmittal of intent to launch logic to the fuze by the pilot just prior to launch. This connects power to the fuze and removes a solenoid interlock from the mechanism. At separation the movement of a rod used to enable the rocket motor initiating device removes a second mechanical interlock from the device. After separation initiation of the rocket motor causes hot gas pressure to be applied to a piston located in the rocket motor section external to the fuze and interfacing with a plunger that extends from the safety-arming mechanism. Action of the piston on the fuze plunger applies arming energy to the mechanism. The mechanism is driven to a second solenoid interlock (commit-to-arm condition) impeded by the action of an escapement. Completion of arming cannot occur until the second solenoid interlock is removed. The logic signal to remove this interlock is generated by the missile guidance when the missile comes in close proximity to the target.

4 Claims, 16 Drawing Figures

FIG. 15.
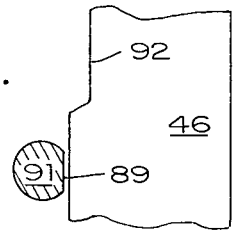
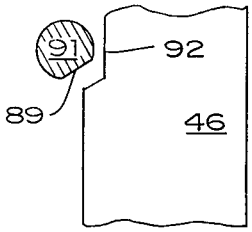
FIG. 16.
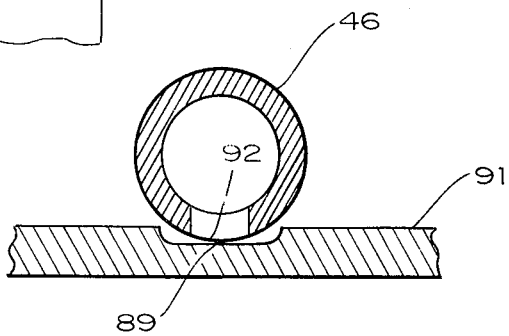
FIG. 4.
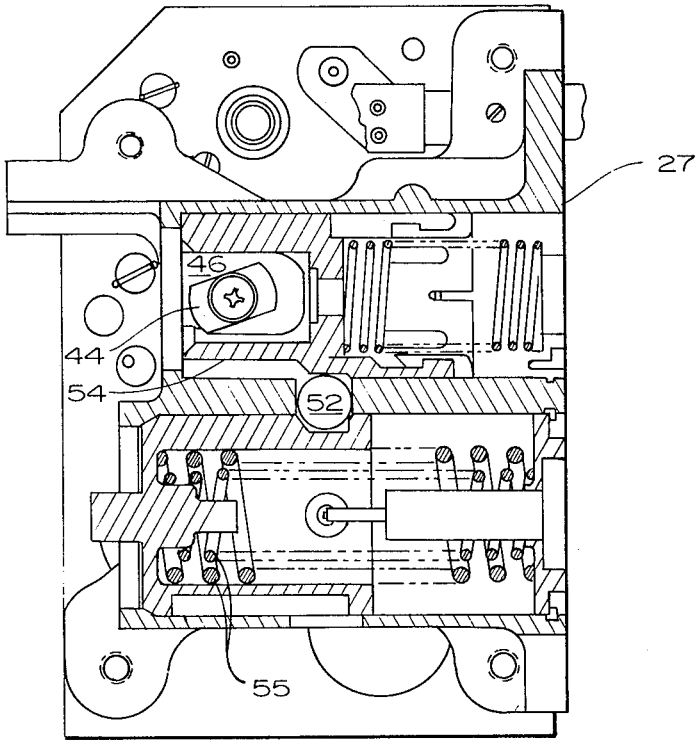
FIG. 5.

GUIDED MISSILE WARHEAD FUZE

BACKGROUND OF THE INVENTION

1. Field of the Invention

The present invention relates to safety-arming devices for use in fuzes.

2. Description of the Prior Art

Many fuzes have been developed for specific missile application. Each were designed to meet the individual missile flight and function parameters. In many cases modification to existing devices have satisfied the fuzing requirements for advanced or new missiles. The functional parameters of the present missile, however, required the design and development of a new fuze to meet the post launch arming requirements of a low acceleration missile.

SUMMARY OF THE INVENTION

The invention is an electromechanical arming device incorporating provisions for a constant time delay for arming under omnidirectional high g loadings and in-line-out-of-line mechanical and electrical circuitry features.

The arming cycle of the present invention includes the transmittal of intent to launch logic to the fuze by the pilot just prior to launch. This event connects power to the fuze and removes a solenoid interlock from the mechanism. At separation, the movement of a rod used to enable the rocket motor initiating device removes a second mechanical interlock from the device. After separation, initiation of the rocket motor causes hot gas pressure to be applied to a piston. This piston is located in the rocket motor section external to the fuze and interfacing with a plunger that extends from the safety-arming mechanism. Action of the piston on the fuze plunger applies arming energy to the safety-arming mechanism. The safety-arming mechanism is driven to a second solenoid interlock (commit-to-arm position) impeded by the action of an escapement. Completion of arming cannot occur until the second solenoid interlock is removed. The logic signal to remove this interlock is generated by the missile guidance when the missile comes in close proximity to the target.

BRIEF DESCRIPTION OF THE DRAWING

FIG. 4 is a cross sectional view in the direction of arrows IV — IV of FIG. 2;

FIG. 5 is a view partly in cross section in the direction of arrows V — V of FIG. 2;

FIG. 15 is a cross sectional view in the direction of arrows XV — XV of FIG. 4 when the fuze is in the safe condition; and FIG. 16 is a cross sectional view similar to FIG. 15 but with the fuze not in the safe condition.

DETAILED DESCRIPTION OF THE INVENTION

Figure 12:
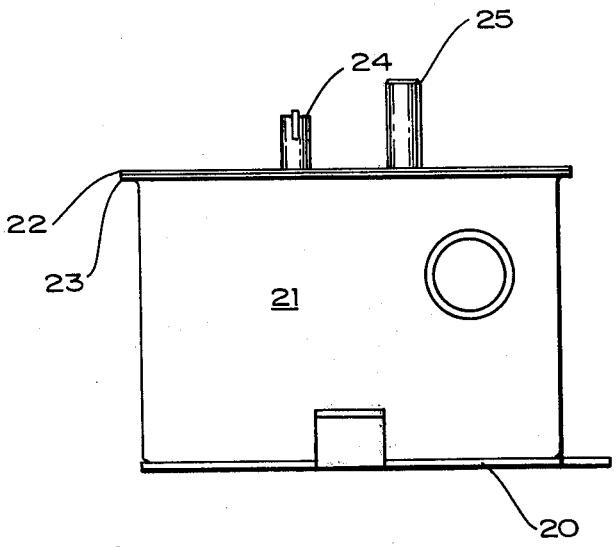
FIG. 12 is an elevational view of the container for the fuze.
Figure 11:
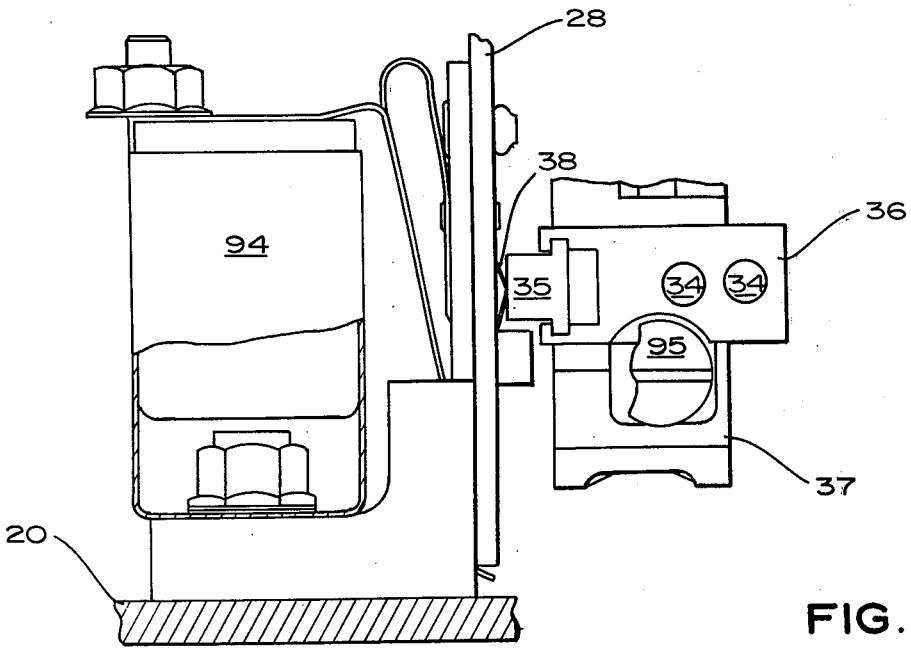
FIG. 11 is an elevational view of the detonator carrier in the armed position.
Figure 13:
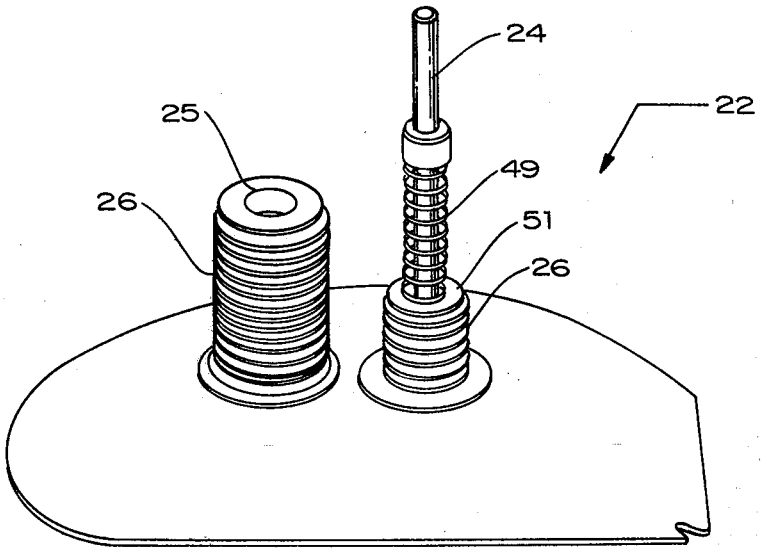
FIG. 13 is a perspective view of the bottom of the container cover assembly.
Figure 14:
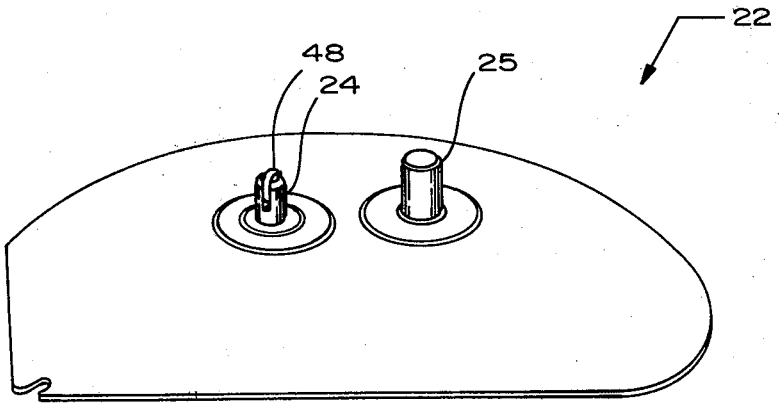
FIG. 14 is a perspective view of the top of the container cover assembly.

The mechanism is mounted on stainless steel base plate 20 (FIG. 12) and is enclosed by "D" shaped housing 21 which is attached and hermetically sealed to base plate 20 and to cover assembly 22 by means of seam or overlapping-stitch welding along the upper flange 23. The mechanical input elements, (launch ramp actuator rod 24 and gas piston plunger 25) are hermetically sealed to the cover by means of bellows 26. These elements are guided into the plunger housing 27 which is machined from an aluminum casting. The mechanism is contained between two stainless steel side plates 28, 30 spaced by pillars 29, explosive lead block 31 and solenoid stators 32, 43.

Plunger housing 27 is mounted directly on base plate 20 and the mechanism assembly is cantilevered to the plunger housing by means of attaching screws 33 passing through pillars 29.

Detonators 34 and detonator contacts 35 are contained in a cartridge-type detonator carrier 36 which is installed in arming rotor 37 as one of the last assembly operations. In the safe position the detonators are confined and electrically isolated from all circuitry.

The detonator electrical leads are attached to detonator contacts 35 which provide circuit continuity upon arming by contacting stationary wiper-contact fingers 38 attached to rear side plate 28.

Arming rotor 37 has an approximate 105° rotation divided into two increments:

The first increment is timed and provides for a safe separation of the missile from the launching aircraft and culminates in the commit-to-arm position at the active transfer initiate (ATI) stop 69. Upon receipt of the ATI signal, the ATI stop is removed and the second increment of rotation occurs, the majority of which is not retarded. This results in snap action of the arming rotor to the fully armed position. The detonator out-of-line condition at the ATI stop insures complete out-of-line safety. The snap arming allows a minimum time in which the firing train is in the gray or unsafe out-of-line condition during the arming cycle.

All rotary elements in the fuze mechanism are statically balanced to help provide immunity against g loading, thereby reducing required functional forces and decreasing the functional time variance of the mechanism.

The fuze operates in the following manner:

Immediately prior to launch of the missile from the aircraft, an intent-to-launch (ITL) signal, originating from the aircraft, is applied to ITL solenoid 41, causing ITL solenoid rotor 42 to rotate through approximately 20° with respect to ITL solenoid stator 43. This in turn rotates the interlock sleeve sear 44, attached to the solenoid rotor shaft 45, disengaging sear 44 from interlock sleeve 46. Additionally, the ITL latch 68 attached to ITL solenoid rotor 42 disengages from integral step 67 of arming rotor 37.

During ejection of the missile from the aircraft, a launch ramp cam 47, located outside the fuze, is actuated and applies a force to rotating cam follower 48, attached to the end of actuator rod 24. Actuator rod 24, collar 51, and compression spring 49 transfer the force developed by the launch ramp cam 47 to interlock sleeve 46. Depression of interlock sleeve 46 frees interlock ball 52 which, in the safe condition, is held between interlock sleeve 46 and gas piston plunger 53 by locking ramps 54, preventing depression of the gas piston plunger 53. With the interlock sleeve fully depressed, interlock ball 52 disengages gas piston plunger 53.

Immediately after launch, the rocket motor of the missile ignites and pressure developed by the rocket motor is used to generate a force external to the fuze which is applied to gas piston plunger 53. The gas piston plunger is preloaded in its initial position with a force of approximately 80 pounds by two nested compression springs 55. If the operation of the rocket motor is normal, the force generated is sufficient to overcome the nested springs and the gas piston plunger is depressed. The plunger is held in the depressed position as long as sufficient pressure is maintained by the rocket motor.

Depression of the gas piston plunger and attached cocking arm drive pin 56 rotates cocking arm 57 through approximately 75°.

During rotation of cocking arm 57, spring 58 is unwound from teflon spool 60. The spring is coupled to cocking arm 57 by means of an integral split pin 59, which capatures the formed end 61 of the spring.

Unwinding of spring 58 from teflon spool 60 results in a force which draws spool 60, and in turn the spool mounting drive pin 62, in the direction of cocking arm 57. Since pin 62 is located near the periphery of timer drive gear 63, this force results in torque which causes the timer drive gear to rotate.

Gear segment 64 on timer drive gear 63 engages arming rotor 37, and gear segment 65 on the timer drive gear engages the pinion 66 of escapement assembly 39. The escapement assembly retards drive gear 63 and the mechanically coupled arming rotor 37 in their rotation toward the armed position.

ATI latch 69 is attached to ATI rotor 71 of ATI solenoid 72. After the arming rotor 37 rotates approximately 64° toward the armed condition, integral step 67 is engaged by the ATI latch and further rotation toward the armed position is prevented.

Figure 1:
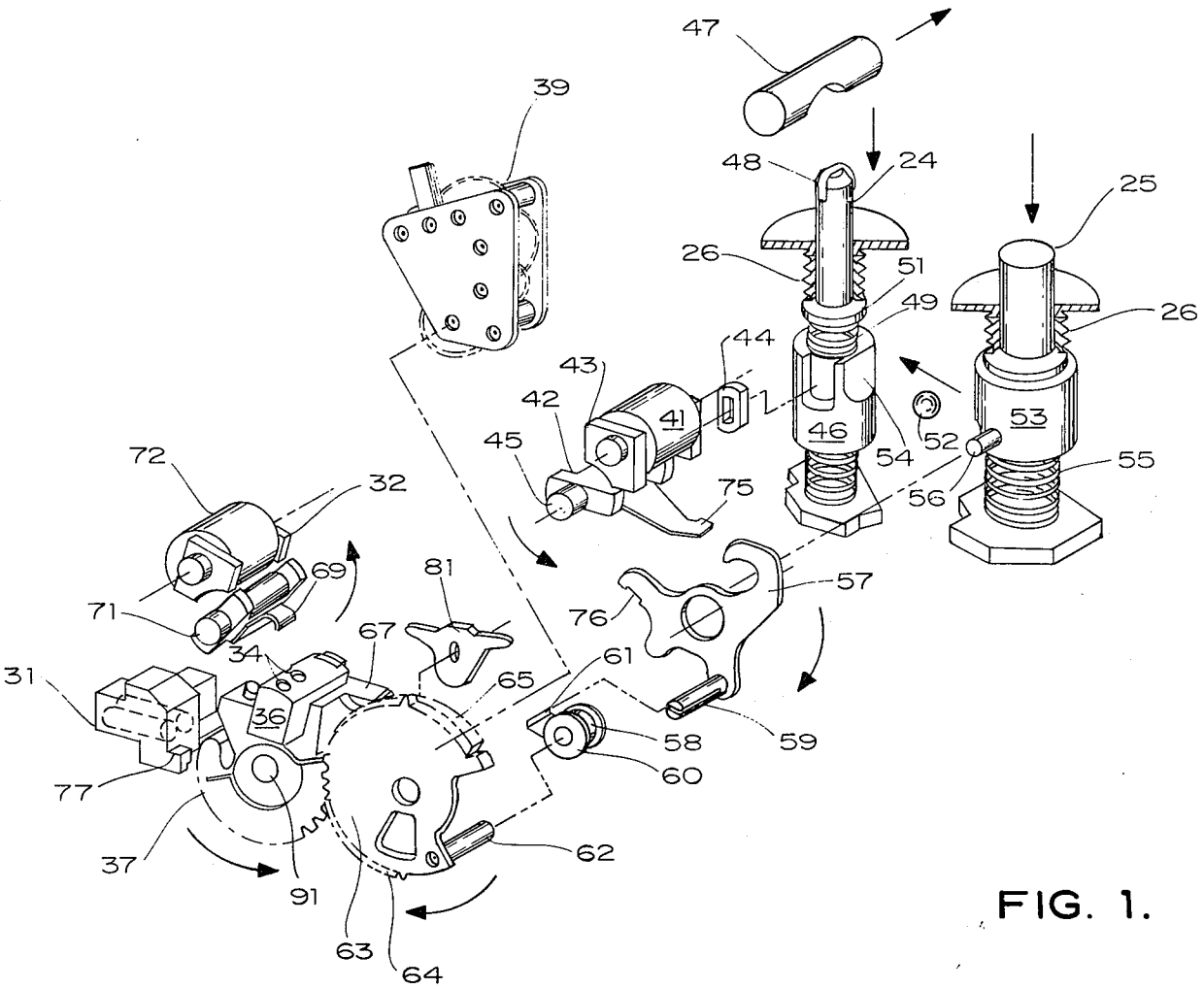
FIG. 1 is an exploded view of the invention.
Figure 2:
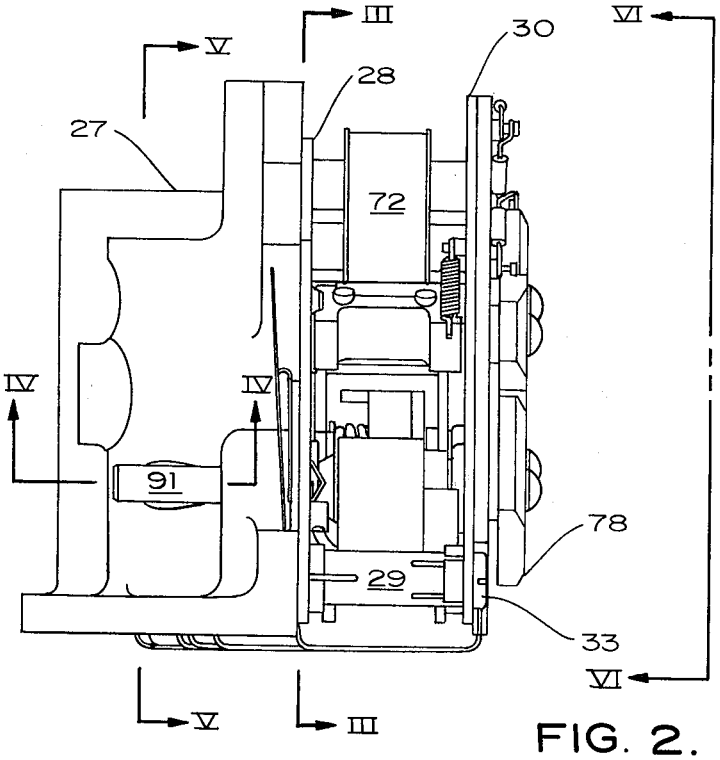
FIG. 2 is a back end view of the invention.
Figure 3:
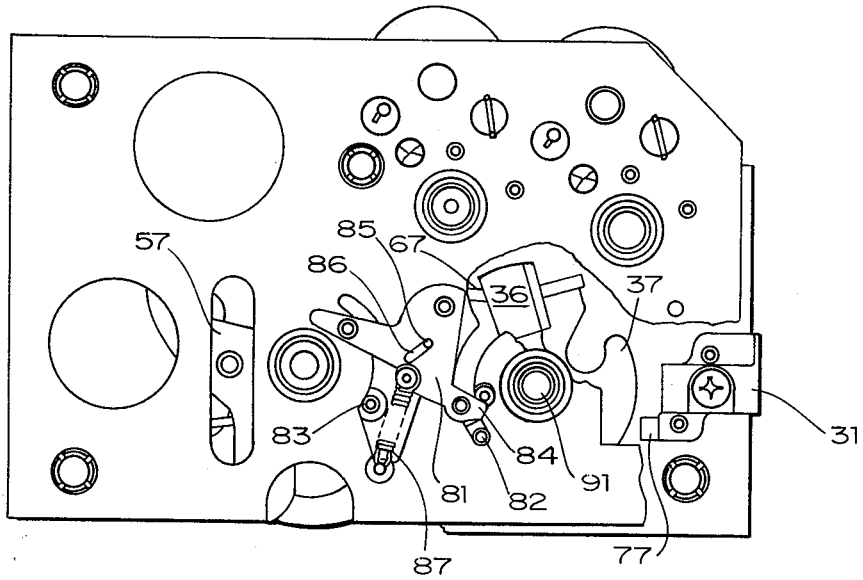
FIG. 3 is a view in the direction of arrows III — III with the plunger housing assembly removed.
Figure 6:
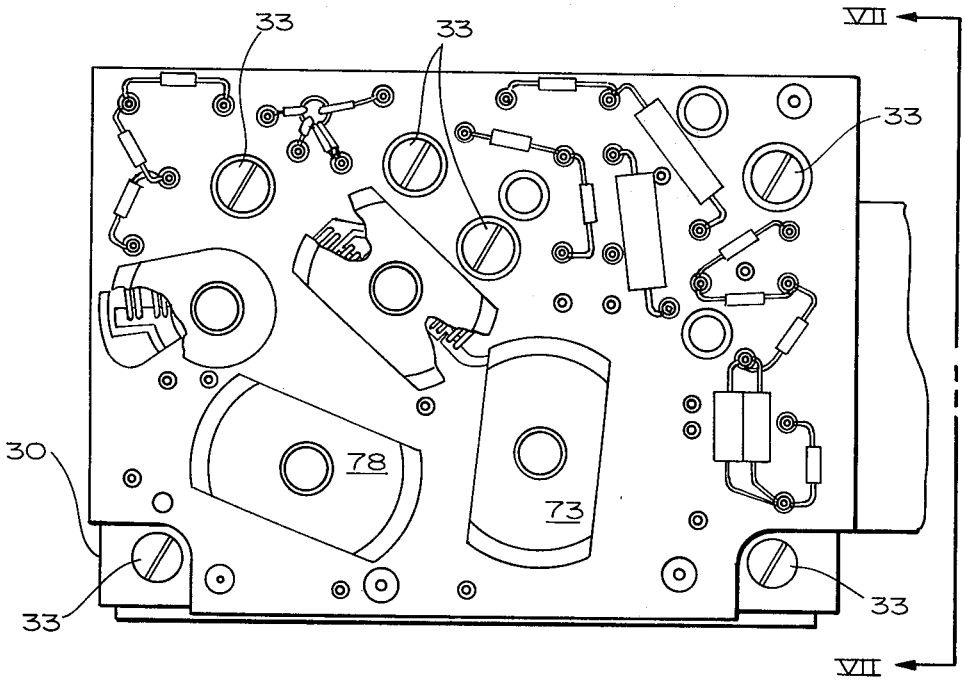
FIG. 6 is a front side view in the direction of arrows VI — VI of FIG. 2.
Figure 7:
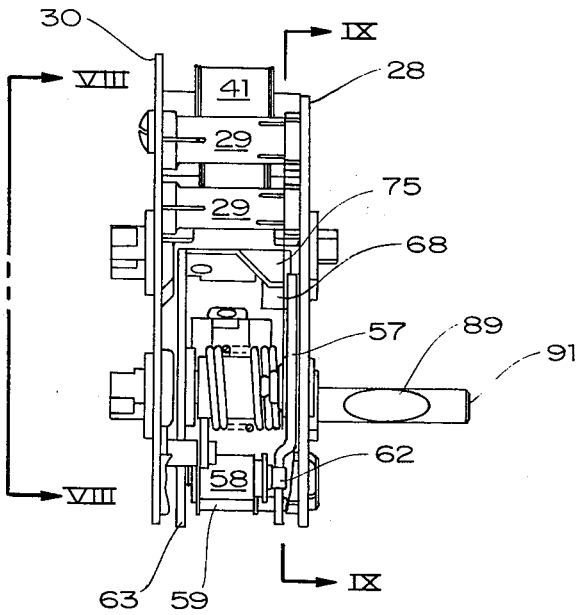
FIG. 7 is a front end view looking in the direction of arrows VII — VII of FIG. 6 with the plunger housing assembly, circuit board, rotary switches and escapement removed.
Figure 8:
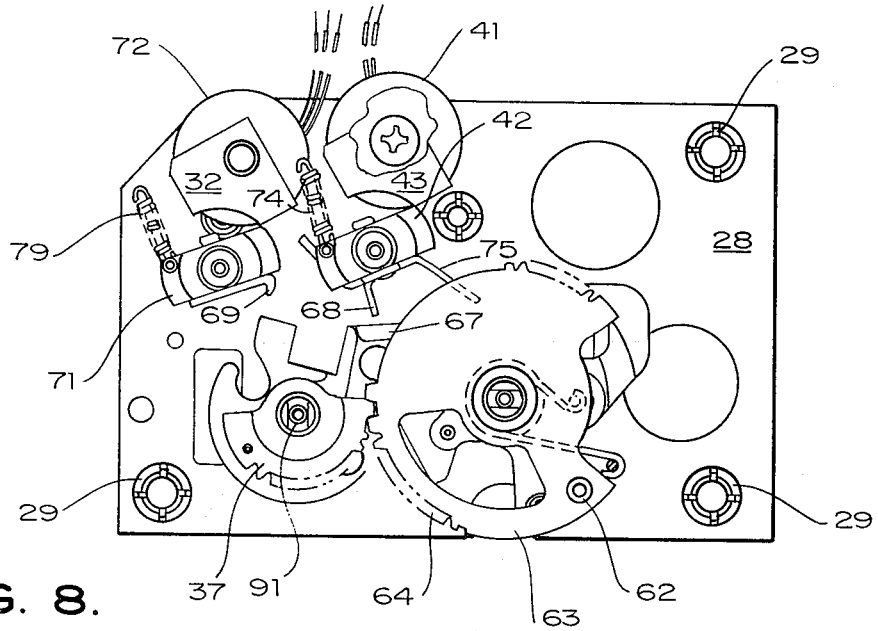
FIG. 8 is a front side view looking in the direction of arrows VIII — VIII of FIG. 7 with the front frame assembly removed.
Figure 9:
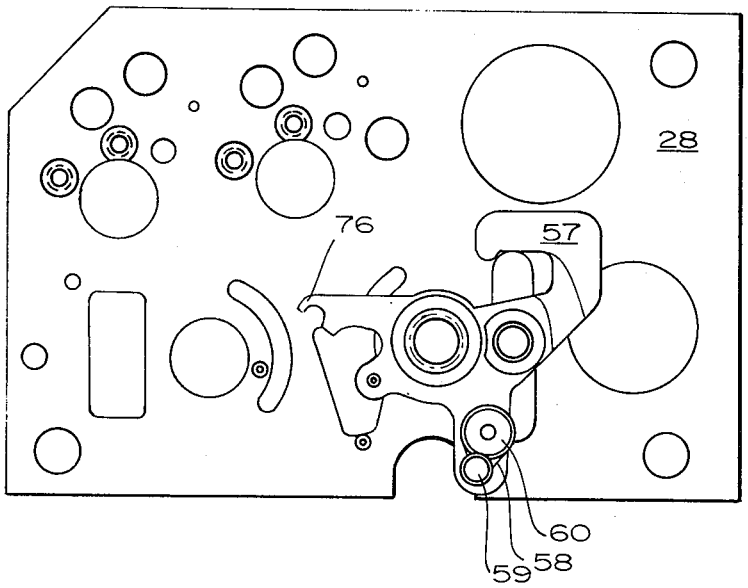
FIG. 9 is a partial section view in the direction of arrows IX — IX of FIG. 7.
Figure 10:
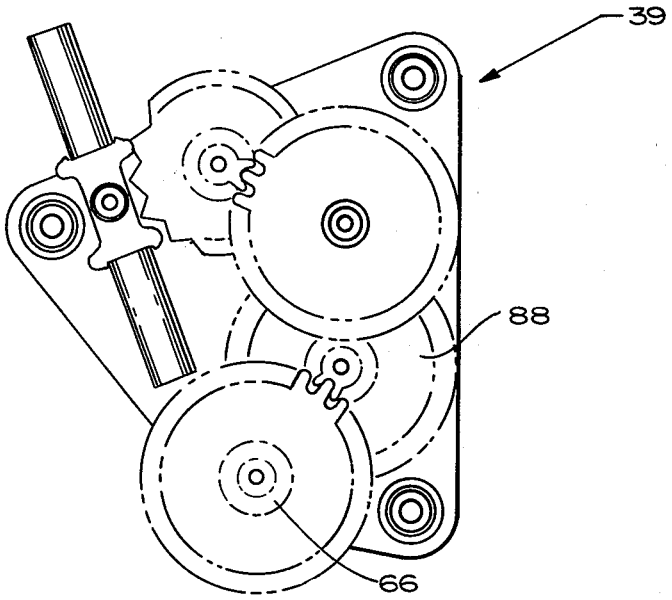
FIG. 10 is an elevational view of the escapement assembly.

Immediately before the arming rotor reaches the ATI latch, the ITL solenoid is deenergized by rotary switch 73 (FIG. 6) attached to the timer drive gear. Extension spring 74 applies a restoring torque to the ITL solenoid rotor, so that when the solenoid is deenergized, the ITL solenoid rotor and the attached ITL latch are returned to their initial position. In this position, tang 75 on the ITL latch engages the cocking arm at 76 and prevents the return of the cocking arm to its initial position. After the rocket motor burns out and rocket motor pressure is lost, the gas piston plunger returns to its initial position independently of the cocking arm. with the cocking arm locked in position by the ITL latch, the timer drive spring 58 remains extended, and driving torque to the arming rotor is maintained. The mechanism is now in the commit-to-arm position.

Upon receipt of the ATI signal, ATI solenoid 72 is energized and ATI rotor 71 with attached ATI latch 69 rotates through approximately 20°. This action disengages the ATI latch from the arming rotor and the arming rotor continues its rotation toward the armed position, still at the rate determined by the retarding effect of the escapement assembly.

After approximately 4° of rotation of the arming rotor past the ATI stop, the segment of teeth in the timer drive gear engaging the escapement assembly terminates contact with the escapement assembly resulting in rapid rotation (snap action) of the arming rotor through the remaining 37° to the armed position. The rate of rotation is limited only by the spring driving torque, friction, and inertial moments of the rotating components.

Detonator carrier 36 containing two electric detonators 34 is attached to the arming rotor 37 by means of an attachment screw 95. When the arming rotor reaches the armed position, the detonator carrier engages a projection 77 of the lead block 31 and further rotation of the arming rotor is prevented. When the armed position is attained, switch 78 driven by the arming rotor disconnects the power supply to the ATI solenoid. The ATI solenoid rotor is returned by the restoring torque exerted by return springs 79. The attached ATI latch engages the arming rotor and locks it in the armed position.

In the armed position, electric detonators 34 are connected to the fuze circuitry by means of a two-pole switch with fixed contacts attached to the detonator carrier assembly. The mating contact fingers 38 of this switch are attached to the rear frame so that the detonators are electrically isolated from the fuze circuitry until the armed position is reached.

An additional safety feature of this invention is provided by fail-safe lever 81. If timer drive gear 63, arming rotor 37 and cocking arm 57 move together as they would if the timer drive gear movement were not restricted by escapement 39, or if gas piston plunger 53 is depressed slowly due to improper rocket motor action, fail-safe lever 81 will not be rotated in a normal manner and will block arming rotor 37 thus preventing arming of the fuze. The addition of this safety feature guarantees proper separation of the missile from the launcher has occurred before the missile can be armed.

The fail-safe lever accomplishes this by the placement of stop and actuating pins relative to the fail-safe lever. During normal arming fail-safe lever 81 is rotated out of the way of pin 82 located on arming rotor 37 by the action of pin 83 located on cocking arm 57. This allows normal functioning of the mechanism. If loss of escapement restriction or slow functioning of the gas piston plunger occurs, the lower end 84 of fail-safe lever 81 is captured between stationary pin 85 mounted on rear frame 28 and the arming rotor pin 82 before 83 can contact the fail-safe lever and in turn blocks the movement of the mechanism. Elongated pivot hole 86 in the fail-safe lever and spring 87 allow full travel of the cocking arm 21 and associated pin 83 without additional rotation of the arming rotor.

Other fail-safe features include:

1. An overriding positive-engagement clutch 88 in the escapement assembly to prevent damage to the escapement by a rapid backup of the gas piston plunger, cocking arm and timer drive gear caused by a loss of rocket motor pressure prior to reaching the commit-to-arm position or malfunction of test equipment.

2. A stop 67 on the arming rotor that functions in conjunction with ITL solenoid latch 68 causing locking of the mechanism in the event of power loss to the ITL solenoid during the initial phase of arming.

3. A flattened extension 89 of arming rotor shaft 91 engages the interlock sleeve 46, when the interlock sleeve is in the up position, preventing the arming rotor from rotating out of the safe position. A flattened portion 92 of the interlock sleeve has been removed so that when the interlock sleeve is fully depressed, arming rotor 91 may rotate into removed portion 92.

4. Electrical indication of safe or armed condition provided by two switches located on switch carriers 73, 78 that are normally closed in the safe position. One of the switches (safe indicator) opens when the fuze mechanism starts to move and the other (armed indicator) opens when the fuze reaches the armed position.

The ITL solenoid rotor, that locks the fuze in its safe position, is actuated by a bifiliar wound coil (U.S. Pat. No. 3,380,008) that has a shorted secondary winding. Shorting the secondary winding reduces to an acceptable level the inductive voltages generated during opening of the solenoid disconnect switch when actuation is no longer required.

The ATI solenoid rotor that prevents complete fuze arming utilizes a bifiliar wound coil similar to that used for the ITL solenoid except the secondary winding is switched in parallel with the primary winding for a short period of time and then shorted. With the primary and secondary windings in parallel, additional starting torque is provided. When the solenoid disconnect switch opens at completion of fuze arming, the shorted secondary winding suppresses the induced voltages.

We claim:

1. A fuze for a guided missile comprising:

a detonator carrier;

a gas piston plunger for supplying a transferring force from a combustion chamber of said guided missile;

a constant force spring wound about a spool and operatively coupled to said plunger for storing energy for positioning said detonation means in an armed position;

means for extending said spring from said spool;

a pin extending through the center of said spool and being freely rotable within said spool;

said pin being attached near the periphery of and being parallel to the axis of a timer drive gear for causing said spring to drive said gear as said spring rewinds about said spool; and means for limiting the dissipation of said energy at a constant rate for delaying the time required by a predetermined amount before arming said fuze.

2. The device of claim 1 wherein said energy dissipation limiting means comprises:

an escapement; and said escapement is driven by said drive gear.

3. The device of claim 2 wherein:

said detonator carrier comprises gear means;

said gear means being driven by said drive gear;

whereby said detonator carrier is positioned in an armed position.

4. The device of claim 2 further comprising:

means for preventing said carrier from moving to a "commit-to-arm" position if said spring fails to extend while said drive gear is rotated;

whereby said carrier will not move to a "commit-to-arm" position in the event of low combustion chamber pressure from the missile or the absence of said escapement.

* * * * *